United States Patent [19]

Reid

[11] Patent Number: 4,574,954

[45] Date of Patent: Mar. 11, 1986

[54] PILL DISPENSER

[75] Inventor: Grahame W. Reid, Novato, Calif.

[73] Assignee: Medication Services Inc., San Rafael, Calif.

[21] Appl. No.: 679,567

[22] Filed: Dec. 7, 1984

[51] Int. Cl.[4] ..... B65D 83/04; B65D 85/56

[52] U.S. Cl. ..... 206/531; 206/532; 206/538; 206/469; 206/471

[58] Field of Search ..... 206/531, 530, 538, 539, 206/532, 461, 469, 471; 220/281

[56] References Cited

U.S. PATENT DOCUMENTS

| | | | |
|---|---|---|---|
| 2,816,666 | 12/1957 | Nadel | 206/461 |
| 3,054,503 | 9/1962 | Hartman, Jr. et al. | 206/531 |
| 3,503,493 | 3/1970 | Nagy | 206/539 |
| 4,158,411 | 6/1979 | Hall et al. | 206/531 |
| 4,187,953 | 2/1980 | Turner | 220/281 |
| 4,371,080 | 2/1983 | Haines | 206/538 |
| 4,429,792 | 2/1984 | Machbitz | 206/531 |
| 4,500,006 | 2/1985 | Lafortune et al. | 220/281 |

*Primary Examiner*—William T. Dixson, Jr.
*Assistant Examiner*—Brenda J. Ehrhardt
*Attorney, Agent, or Firm*—Thomas M. Freiburger

[57] ABSTRACT

A pill dispenser of the type having a plastic bubble containing each pill with frangible foil backing, has an improved construction enabling easier release of the pill through the foil. Each clear plastic bubble includes a raised circular blister at its top, on an otherwise generally planar plateau area. When the pill is forced out by the finger or thumb of the user, the raised blister is pushed inside out and assists in providing the required depth and force to push the pill out through the foil.

6 Claims, 4 Drawing Figures

PILL DISPENSER

BACKGROUND OF THE INVENTION

The invention relates to pill dispensers, and more particularly to an improved bubble-type pill dispenser of the type wherein the bubble is pushed in and deformed in order to force a contained pill out through a foil backing.

Bubble-type pill dispensers are well known. For example, see U.S. Pat. Nos. 3,211,503, 3,283,885, 3,311,229, 3,324,996, 3,380,578, 3,397,671, 3,494,322, 3,630,346, 3,759,371, 3,856,144, 4,211,326 and 4,429,792. These prior patents generally show conventional bubble-type pill packaging wherein the thin plastic bubble containing the pill is pushed inwardly by the thumb or finger of the user to force the pill out through a frangible foil backing in a window card. Sparks U.S. Pat. No. 3,380,578 listed above, shows a plastic bubble with a form of raised central portion (see FIG. 2 of the patent), which forms a receptacle area for the contained pill but otherwise performs no special function relating to assisting in the task of releasing the pill. Machbitz U.S. Pat. No. 4,429,792 listed above shows a form of compound blister in a bubble-type pill dispenser.

None of the patents or devices of the prior art has provided for easy, light-pressure release of a pill through a foil backing to the extent of the present invention described below.

SUMMARY OF THE INVENTION

The present invention relates to an improved bubble-type pill dispenser closed at the back by a sheet of frangible material such that the bubble can be pushed inwardly and deformed to force the pill through the frangible material. In the front of the bubble is a generally flat peripheral plateau area. A blister of round or oval configuration extends convexly forward from and is integrally formed with the peripheral plateau area and with the remainder of the bubble. The blister is generally centrally located in the front of the bubble and positioned to engage the contained pill when pushed inwardly. Where the blister meets the peripheral plateau area there is a generally circular sharp break line, the break line of relatively thinner plastic than the blister. By this configuration, the blister can be pushed inwardly by the finger or thumb of a user with relatively little force, causing it to pop into an inside-out configuration, bending along the break line. The sharp break line acts as a living hinge so that it is quite easy to pop the blister from convex to concave, and the pill is easily pushed through the frangible material, aided in part by the force of the blister popping inside out.

The plastic sheet with the pill-containing bubbles is advantageously formed by drawing in a thermoforming process between two rigid plates. The stretching of the plastic material at the break line in the thermoforming process has the effect of thinning the material at the break line, making it considerably thinner than the rounded blister.

It is therefore among the objects of the invention to improve on prior bubble-type pill dispensers by providing a thermoformed clear plastic bubble-type dispenser with a special raised blister that, partly as a result of the thermoforming process itself, greatly aids the user in pushing the pill through the frangible material at the back of the dispenser.

These and other objects, advantages, features and characteristics of the invention will be apparent from the following description of a preferred embodiment, considered along with the accompanying drawings.

DESCRIPTION OF A PREFERRED EMBODIMENT

Figure 1:
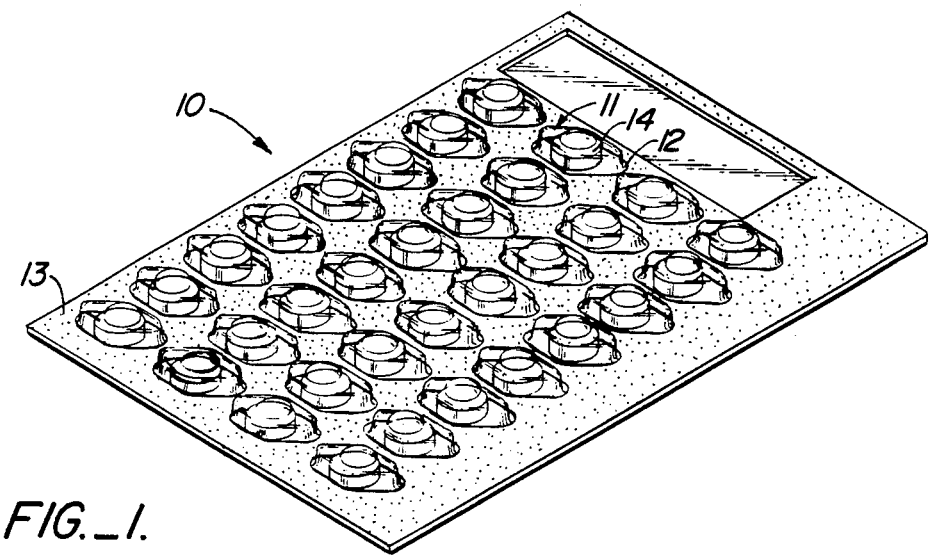
FIG. 1 is a perspective view showing a bubble-type pill dispenser according to the invention.
Figure 2:
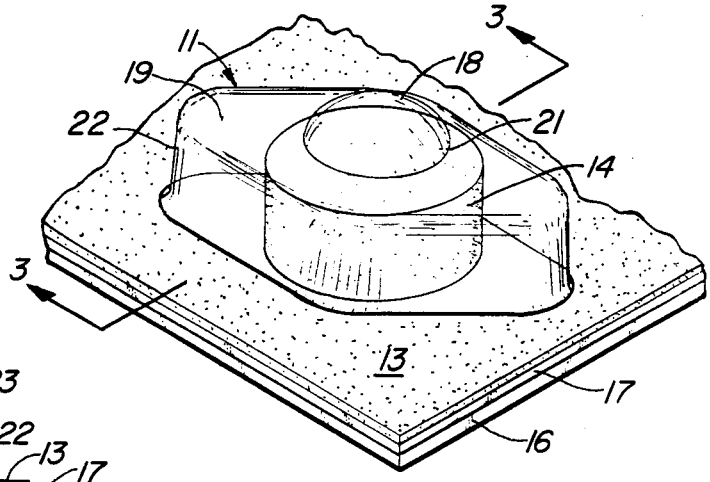
FIG. 2 is a perspective detailed view showing a portion of the pill dispenser, with one pill-containing bubble.
Figure 3:
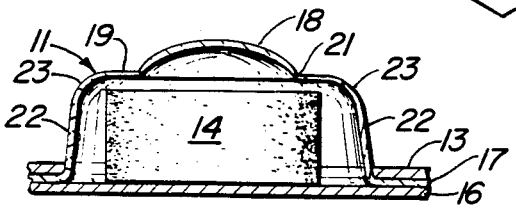
FIG. 3 is a sectional view in elevation of one of the clear plastic pill-containing bubbles of the dispenser, as viewed generally along the line 3—3 in FIG. 2.

In the drawings, FIG. 1 shows a pill dispenser sheet 10 having a plurality of plastic bubbles 11, preferably clear plastic bubbles as shown, protruding forward through windows 12 of a window card 13. Each bubble 11 contains a pill 14, and each is sealed into the bubble by a sheet 16 of frangible material, preferably foil, adhered peripherally around the back side of each bubble 11. The bubbles 11 preferably are integrally formed in a clear plastic sheet 17 from which each protrudes forward in position to extend through the windows 12 of the window card 13.

As thus far described, the bubble-type pill dispenser 10 is similar to those typically described in the prior art. However, according to this invention there is included in each bubble 11 a generally rounded blister 18, which may be a portion of a sphere or of an oval or elliptical configuration. The blister 18 protrudes forward from a peripheral plateau area 19 at the front of the bubble. The area 19 preferably is generally planar. As indicated in the figures, the raised blister 18 preferably breaks upwardly relatively sharply from the plateau area 19 along a break line 21. The break line 21 is of a lesser thickness than that of the raised blister 18 itself, an important feature of the invention. This may be achieved in a thermoforming process, wherein the entire plastic sheet 17 of pill-containing bubbles 11 is drawn from a sheet of material and formed between two rigid plates.

The diameter of the blister 18, i.e. that of the circle defined by the break line 21, may be about 8 mm on a bubble with a major dimension of about 18 mm, but these dimensions may vary with the size of the pill and the thickness of the plastic material.

The pill dispenser of the invention by be embodied in a single bubble 11, backed by frangible material 16, for an individual dose. Such individual bubbles may be connected in a strip with perforations for tearing off each bubble.

The plastic material for the bubble sheet 17 may be polyvinyl chloride, polypropylene, polyethylene or other suitable material. In the thermoforming process, the plastic material is stretched, and it is well-known that the material will thin out where stretched around sharper corners or angles and will not thin out as much where stretched around a generous radius. This principle is used to advantage in the invention. A side wall 22 of the bubble is formed at a slight angle (7°–10°), going into a relatively small radius 23 at a shoulder and then into a very sharp angle at the break line 21, then into a very generous radius (or other curve) forming the blister 18. The sharp break line 21 is therefore quite thin, while the radiused shoulder is somewhat thinned out, the rounded blister 18 being thicker than both. THe peripheral plateau area 19 preferably is also somewhat thinner than the blister 18.

As an example, in one form of the invention, the base plastic material, i.e. the base sheet 17 from which the bubbles are formed in the thermoforming process, may be about 0.010 inch. The side wall 22 may be somewhat thinner, perhaps 0.009 inch or less near the bottom and 0.008 inch approaching the shoulder radius 23, then narrowing to about 0.006–0.005 inch in the shoulder 23. The plateau area 19 may be about 0.005 inch, and the break line 21 about 0.003–0.002. The blister 18 may be about 0.008 inch thick.

Figure 4:
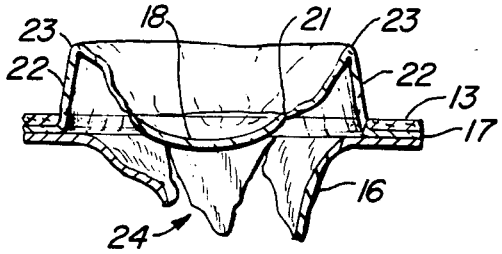
FIG. 4 is a view similar to FIG. 3, but showing the pill-containing bubble after it has been compressed inwardly and deformed to force the pill to break through the frangible material at the back of the bubble.

Because the raised blister 18 is of relatively thicker material, it tends to pop inwardly, into an inside-out configuration, by bending about the break line 21 when pressure is applied centrally to the bubble and the bubble is pushed inwardly as shown in FIG. 4. Along with the force exerted on te blister 18, the relatively thinner plateau area 19 deflects inwardly ven before the blister pops in, by bending itself somewhat and by bending of the shoulder 23. Once popped in, the blister assumes a relatively rigid posture in the inside-out configuration, with the plastic material tending to bend uniformly along the break line 21 as shown. At the same time, the radiused shoulder 23 also bends further inwardly as shown, and the plateau area deflects downwardly further.

As a result, as shown in FIG. 4, the required dpeth to push the pill 14 through the frangible backing material 16, causing a rip or break 24 as shown, is easily achieved with the bubble configuration of the present invention. Much less resistance is encountered by the user than normally encountered with bubble-type pill dispensers of the prior art. The popping of the blister 18 inside-out adds a force that actually assists in pushing the pill out.

The present invention is useful with a variety of shapes and sizes of pills. For example, in addition to the configuration of bubble 11 shown, which may be used for a round pill or an oval pill, the pill dispenser sheet 10 can be formed with circular or other shapes of bubbles, but still with a generally rounded raised blister 18 as shown and described, for best results in deformation of the bubble to eject the pill. The generally rounded blister is shown circular, but it can be oval or elliptical.

The described embodiments are not intended to be limiting, and variations to these embodiments will be apparent to those skilled in the art and may be made without departing from the spirit and scope of the invention as defined in the following claims.

I claim:

1. In a bubble-type pill dispenser of the kind including at least one plastic pill-containing bubble closed at the back by a sheet of frangible material such that the bubble can be pushed inwardly and deformed to force the pill through the frangible material, the improvement comprising:

a peripheral plateau area in the front of the clear plastic bubble; and a rounded blister extending convexly forward from the peripheral plateau area and integrally formed with the bubble, generally centrally located in the front of the bubble and positioned to engage the contained pill when pushed inwardly, the blister meeting the peripheral plateau area in a sharp generally circular break line defining the periphery of the blister;

the plastic material of the bubble being thinner at the break line than in the blister;

whereby the blister can be pushed inwardly by the finger or thumb of a user with relatively little force, causing it to pop into an inside-out configuration, bending along the break line, assisting in easily pushing the pill through the frangible material.

2. The improvement of claim 1, wherein the plastic bubble is drawn from a sheet of material in a thermoforming process, whereby the material naturally thins out where it is stretched over the sharp break line.

3. The improvement of claim 1, wherein the blister is shaped generally as a portion of a sphere.

4. The improvement of claim 1, wherein the bubble has a radiused shoulder at the periphery of the peripheral plateau area, the plastic material being somewhat thinner at the radiused shoulder than in the blister, whereby the shoulder also bends inwardly when the blister is pushed in, further assisting in dispensing the pill through the frangible material.

5. The improvement of claim 4, wherein the plastic material in the peripheral plateau area is also somewhat thinner than in the blister, whereby the plateau area first deflects inwardly through bending in the plateau area and in the radiused shoulder, then the blister pops into inside-out configuration as the shoulder and plateau area bend further.

6. The improvement of claim 1, wherein the pill dispenser includes a plurality of clear plastic pill-containing bubbles, and further including a window card with openings through which the pill-containing bubbles protrude.

* * * * *